US009903196B2

(12) United States Patent
Sanchez et al.

(10) Patent No.: US 9,903,196 B2
(45) Date of Patent: Feb. 27, 2018

(54) PRESSURE TEST AND ACTUATION TOOL AND METHOD

(71) Applicants: James S. Sanchez, Tomball, TX (US); Jason M. Harper, Houston, TX (US)

(72) Inventors: James S. Sanchez, Tomball, TX (US); Jason M. Harper, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 199 days.

(21) Appl. No.: 14/737,996

(22) Filed: Jun. 12, 2015

(65) Prior Publication Data

US 2016/0362974 A1 Dec. 15, 2016

(51) Int. Cl.

| | |
|---|---|
| ***E21B 34/10*** | (2006.01) |
| ***E21B 47/06*** | (2012.01) |
| ***E21B 34/08*** | (2006.01) |

(52) U.S. Cl.

CPC ..... *E21B 47/06* (2013.01); *E21B 34/085* (2013.01); *E21B 34/10* (2013.01)

(58) Field of Classification Search

CPC ..... E21B 47/06; E21B 34/085; E21B 34/10; E21B 34/108; E21B 34/063; E21B 34/125; E21B 1/10; E21B 31/113; E21B 4/14; F16K 3/188

USPC ..... 166/373, 386; 175/297

See application file for complete search history.

(56) References Cited

U.S. PATENT DOCUMENTS

| | | | | |
|---|---|---|---|---|
| 3,964,305 | A * | 6/1976 | Wray | E21B 33/12 166/321 |
| 4,865,125 | A * | 9/1989 | De Cuir | E21B 31/113 166/178 |
| 5,810,087 | A | 9/1998 | Patel | |
| 5,819,853 | A * | 10/1998 | Patel | E21B 34/063 166/319 |
| 8,555,960 | B2 | 10/2013 | Mailand et al. | |
| 2003/0192687 | A1 | 10/2003 | Goodson et al. | |
| 2006/0048940 | A1 | 3/2006 | Hromas et al. | |
| 2013/0233407 | A1 | 9/2013 | Tarczewski et al. | |
| 2015/0152725 | A1* | 6/2015 | Thomas | E21B 47/09 166/255.1 |

FOREIGN PATENT DOCUMENTS

WO 2010096309 A1 8/2010

OTHER PUBLICATIONS

"Howitzer", Interra Energy Services Ltd brochure; Calgary Alberta, Canada; 2 pages.

LinX Toe Valve TD, TC-MV551-000; GeoDynamics Engineered Perforating Solutions; Millsap, TX, USA; www.perf.com; 1 page.

(Continued)

*Primary Examiner* — David Bagnell
*Assistant Examiner* — Dany Akakpo
(74) *Attorney, Agent, or Firm* — Cantor Colburn LLP

(57) ABSTRACT

A pressure test and actuation tool includes a housing; an insert disposed in operable communication with the housing. A metering head initially in sealed relation to both the housing and insert. A damper relief shoulder operably positioned relative to the metering head to initially support the metering head in sealed relationship with the housing and the insert and movable to unsupport the metering head defeating the sealed relationship with the housing and the insert. A method actuating a tool.

10 Claims, 1 Drawing Sheet

(56) References Cited

OTHER PUBLICATIONS

Notification of Transmittal of the International Search Report and the Written Opinion of the International Searching Authority, or the Declaration; PCT/US20106/031817; dated Sep. 1, 2016; 11 pages.
RapidStart Initiator CT Sleeve brochure; Halliburton Completion Tools; 1 page.

* cited by examiner

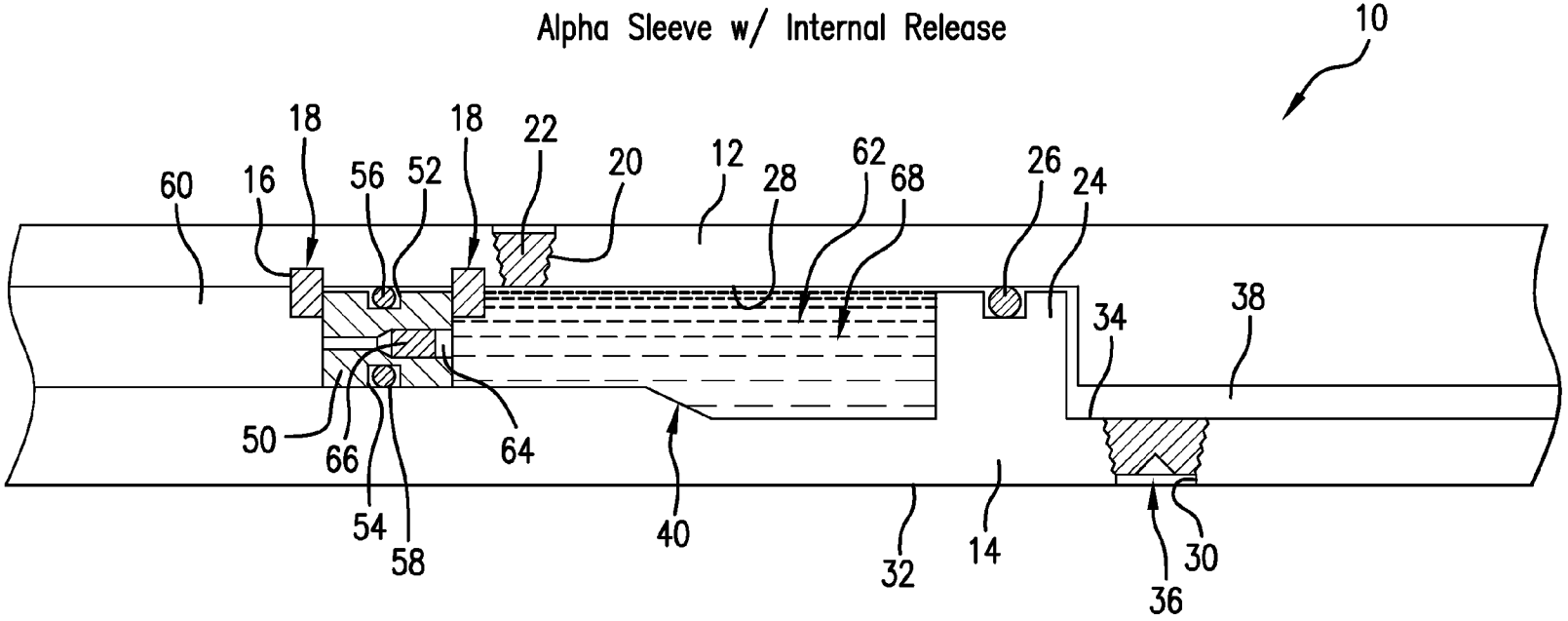
Alpha Sleeve w/ Internal Release
10
38
30
36
34
24
26
14
32
68
62
28
12
40
20
22
64
18
52
58
56
54
66
18
16
50
60

PRESSURE TEST AND ACTUATION TOOL AND METHOD

BACKGROUND

In the downhole industry, it is often desirable to facilitate interventionless actions in the subsurface environment. One example is to open a valve without the need for a separate run, such as a cementing valve for example. Such, it is known, can be accomplished by configuring the valve to respond to an application of pressure. This is common in toe initiation operations as well as in other operations in the borehole. In view of regulations requiring pressure testing however, the use of conventional interventionless valves becomes problematic. Requirements to hold pressure before any actuation occurs and yet to allow actuation at the same pressures complicates tools and processes. Because it is economically advantageous to avoid the need for intervention, the art will well receive new configurations that meet regulations while maintaining the ability to act interventionlessly.

BRIEF DESCRIPTION

A pressure test and actuation tool includes a housing; an insert disposed in operable communication with the housing; a metering head initially in sealed relation to both the housing and insert; a damper relief shoulder operably positioned relative to the metering head to initially support the metering head in sealed relationship with the housing and the insert and movable to unsupport the metering head defeating the sealed relationship with the housing and the insert.

A downhole valve includes a housing; an insert sealingly mated to the housing to divide a volume created between the insert and the housing; a metering head sealingly mated to the housing and to the insert to further divide the volume between the housing and the insert, the housing, insert and metering head creating three individual pressure chambers; a volume of hydraulic fluid in one of the chambers, the fluid being in operable communication with the metering head the fluid being expressable through the metering head to another of the chambers; and a damper relief shoulder in operable communication with the metering head to during use, unsupport the metering head thereby undermining sealing between the metering head, the housing and the insert.

A pressure test and actuation tool includes a pressure defeatible configuration allowing tubing pressure to access the valve at a selected pressure; and a metering head configured to meter fluid transfer within the valve, the valve configured to unsupport the metering head thereby defeating metering.

A method actuating a tool includes pressuring up on the tool a pressure test and actuation tool includes a housing; an insert disposed in operable communication with the housing; a metering head initially in sealed relation to both the housing and insert; a damper relief shoulder operably positioned relative to the metering head to initially support the metering head in sealed relationship with the housing and the insert and movable to unsupport the metering head defeating the sealed relationship with the housing and the insert; metering fluid through the metering head; unsupporting the metering head by repositioning of the damper relief shoulder; and moving fluid around the metering head at a rate exceeding the metering rate.

BRIEF DESCRIPTION OF THE DRAWINGS

The following descriptions should not be considered limiting in any way. With reference to the accompanying drawings, like elements are numbered alike:

The FIGURE is a schematic quarter section view of a pressure test and actuation tool as disclosed herein.

DETAILED DESCRIPTION

A detailed description of one or more embodiments of the disclosed apparatus and method are presented herein by way of exemplification and not limitation with reference to the FIGURE.

Referring to the FIGURE, a tool 10, which may be a valve, is illustrated in a closed position. The valve 10 comprises a housing 12 and a movable insert 14 disposed therein. The housing is configured with grooves 16 to receive retaining rings 18. The rings 18 may be snap rings or any other type of locating ring or even locating studs. In some embodiments, the housing 12 will include a fill port 20 and plug 22. This may be used to add hydraulic fluid to the valve 10 at an appropriate time and seal it therein with the plug. The insert 14 is configured with an upset portion 24 that acts as a piston. The upset portion 24 is provided with a seal 26 such as an O-ring. The seal is configured and positioned to interact with an inside surface 28 of the housing 12, providing a seal thereagainst. The sealing interaction with the housing of the upset 24 will act to segregate individual fluid chambers or divide a volume into individual chambers. Other features of the insert 14 include a fluid pathway 30 that will allow fluid communication from a first surface 32 of the insert 14 to a second surface 34 of insert 14 at any time that a pressure member or pressure defeatible configuration 36, such as a burst disk, check valve, etc., is either not intact or not seated in the pathway 30. In the FIGURE, the pressure member is a burst disk and responds to pressure that exceeds a threshold pressure in an inside diameter (ID) of a tubing string of which the valve 10 is a part. It will be noted that the surface 34 is exposed to a chamber that is at relatively low pressure when compared to downhole pressure. In an embodiment, the pressure in that chamber is atmospheric pressure. The insert 14 further includes a damper relief shoulder 40. The function of this feature will become apparent below in connection with operation of the valve.

Another component of the valve 10 is a meter head 50 that in one embodiment is annular and axially fixed in the initial sealed position. In other embodiments, the valve 10 could be configured with individual meter heads arranged annularly that could look identical in the FIGURE. The meter head 50 features a seal receptacle 52 at an outside diameter thereof and a seal receptacle 54 at an inside diameter thereof In operable communication with the receptacles are seals 56 and 58, respectively, such as O-rings. Seal 56 sealingly cooperates with housing 12 while seal 58 sealingly cooperates with insert 14 thereby creating two fluid chambers 60 (lower or atmospheric pressure) and 62, one on either side of meter head 50. It is also to be appreciated from the FIGURE that the meter head 50 includes one or more bores 64 therethrough (one illustrated) and located in an annular pattern about the annulus defined by the meter head 50. Each of the one or more bores 64 is configured to accept a metering insert 66 from a plurality of available individual metering inserts that can be selected for the degree of fluid flow therethrough that is desired for a particular application. As should be appreciated in the FIGURE, the bore 64 is tapered. This will effect retention of the metering insert 66. Of course, other means of retaining the metering insert are also contemplated such as threaded connection, snap ring, configuring the metering insert with a portion thereof too large to enter the bore 64, etc.

Turning now to operation of the valve 10, it is first pointed out that as illustrated, the valve had been loaded with hydraulic fluid 68 in chamber 62. As above noted, it is important that an interventionless valve 10 as described herein facilitate a pressure hold test to comply with local regulations. Valve 10 does this as well as actuating via tubing pressure as follows. Upon increasing ID pressure in the tubing string within which the valve 10 is disposed will be tolerated until it exceeds a threshold pressure of pressure member 36 whereafter, fluid and pressure will progress through pathway 30 into atmospheric chamber 38. This tubing pressure will now act on upset 24 urging the insert 14 leftwardly in the FIGURE. Opposing this motion is the hydraulic fluid 68, the fluid being essentially incompressible. That is not to say that the hydraulic fluid prevents movement but rather that there is a resistance because the hydraulic fluid is not in a lock condition but is rather merely flow restricted by the metering head 50. Accordingly, pressure applied to the hydraulic fluid will result in hydraulic fluid metering through metering head 50 at a selected rate into low pressure chamber (e.g. atmospheric) 60. This restriction in hydraulic fluid movement ensures that pressure on the tubing string can be maintained for a sufficient time to meet regulations while still allowing for actuation of the valve 10 upon nothing more than tubing pressure. In addition, the damper relief shoulder performs another interesting function in the valve 10. Because the insert 14 is moving leftwardly as disclosed above, it will be appreciated that the damper relief shoulder will move under (in the FIGURE) the metering head 50 to unsupport the metering head thereby defeating the sealed relationship the metering head previously had with the housing and the insert.

More specifically, when the damper relief shoulder 40 moves to a position that the metering head 50 is no longer supported by the insert 14 in its position of sealing with the housing 12, the metering head 50 will lose the function of both seals 56 and 58, thereby allowing hydraulic fluid to rush around metering head 50 into chamber 60. This adds to functionality of the valve 10 because it results in the insert 14 being slammed open. In view of the harsh conditions downhole including cement that might be used with a valve of this construction, slamming the valve open will help to avoid components hanging up on debris or cement and reducing effectiveness of the valve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the FIGURE and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A pressure test and actuation tool comprising:
- a housing;
- an insert disposed in operable communication with the housing;
- a metering head initially in sealed relation to both the housing and insert, the metering head being axially fixed in the tool when in the initial sealed relation;
- a damper relief shoulder operably positioned relative to the metering head to initially support the metering head in sealed relationship with the housing and the insert and movable to unsupport the metering head defeating the sealed relationship with the housing and the insert.

2. The pressure test and actuation tool as claimed in claim 1 wherein the damper relief shoulder is a part of the insert.

3. The pressure test and actuation tool as claimed in claim 1 wherein the insert further includes an upset configured to sealingly interact with the housing to segregate a low pressure chamber.

4. The pressure test and actuation tool as claimed in claim 3 wherein the chamber is an atmospheric chamber.

5. The pressure test and actuation tool as claimed in claim 3 wherein the upset further includes a seal.

6. A method actuating a tool comprising:
- pressuring up on the tool as claimed in claim 1;
- metering fluid through the metering head;
- unsupporting the metering head by repositioning of the damper relief shoulder; and
- moving fluid around the metering head at a rate exceeding the metering rate.

7. A pressure test and actuation tool comprising:
- a housing;
- an insert disposed in operable communication with the housing;
- a metering head initially in sealed relation to both the housing and insert wherein the metering head is configured to receive one of a plurality of individual metering inserts; and
- a damper relief shoulder operably positioned relative to the metering head to initially support the metering head in sealed relationship with the housing and the insert and movable to unsupport the metering head defeat the sealed relationship with the housing and the insert.

8. The pressure test and actuation tool as claimed in claim 7 wherein each of the plurality of individual metering inserts is configured to meter a specific volume of fluid over time.

9. A downhole valve comprising:

a housing;

an insert sealingly mated to the housing to divide a volume created between the insert and the housing;

a metering head sealingly mated to the housing and to the insert to further divide the volume between the housing and the insert, the housing, insert and metering head creating three individual pressure chambers;

a volume of hydraulic fluid in one of the chambers, the fluid being in operable communication with the metering head the fluid being expressable through the metering head to another of the chambers; and a damper relief shoulder in operable communication with the metering head to during use, unsupport the metering head thereby undermining sealing between the metering head, the housing and the insert.

10. A pressure test and actuation tool comprising:

a pressure defeatible configuration allowing tubing pressure to access the tool at a selected pressure; and a metering head configured to meter fluid transfer within the tool, the tool configured to unsupport the metering head thereby defeating metering.

* * * * *